United States Patent [19]

Persson

[11] Patent Number: 4,575,856

[45] Date of Patent: Mar. 11, 1986

[54] IRON FREE SELF BAKING ELECTRODE

[75] Inventor: John A. Persson, Gibsonia, Pa.

[73] Assignee: Pennsylvania Engineering Corporation, Pittsburgh, Pa.

[21] Appl. No.: 612,039

[22] Filed: May 18, 1984

[51] Int. Cl.[4] ..... H05B 7/09

[52] U.S. Cl. ..... 373/89; 373/97

[58] Field of Search ..... 373/89, 97, 91, 92

[56] References Cited

U.S. PATENT DOCUMENTS

| | | | |
|---|---|---|---|
| 473,117 | 4/1892 | Heronult | 373/91 |
| 582,721 | 5/1897 | Deuther | 373/92 |
| 937,885 | 10/1909 | Sterling | 373/93 |
| 1,018,003 | 2/1912 | Redlich | 373/92 |
| 1,441,037 | 1/1923 | Söderberg | 373/89 |
| 1,579,824 | 4/1926 | Laurell | 373/92 |
| 1,613,212 | 1/1927 | Westly | 373/89 |
| 1,640,735 | 8/1927 | Söderberg | 373/89 |
| 1,679,284 | 7/1928 | Westly | 373/89 |
| 1,686,474 | 10/1928 | Söderberg | 373/89 |
| 1,723,582 | 8/1929 | Sem | 373/89 |
| 2,692,205 | 10/1954 | Greider et al. | 106/162 |
| 3,365,533 | 1/1968 | Alexander | 373/89 |
| 3,476,586 | 11/1969 | Valtchey et al. | 117/71 |
| 3,524,004 | 8/1970 | Van Nostran et al. | 373/89 |
| 3,549,739 | 12/1970 | Roche, Jr. | 264/162 |
| 3,619,465 | 11/1971 | Cavigli | 373/89 |
| 3,715,439 | 2/1973 | Persson | 373/89 |
| 3,715,440 | 2/1973 | Gordon et al. | |
| 3,819,841 | 6/1974 | Persson | 373/89 |

*Primary Examiner*—Roy N. Envall, Jr.
*Attorney, Agent, or Firm*—Fred Wiviott

[57] ABSTRACT

An iron free self baking electrode comprises an outer metallic shell, a center core formed of a graphite or prebaked carbon material spaced from the shell and a quantity of a carbonaceous paste which cures into a solid electrode and bonds to the graphite or prebaked carbon core as the core and paste passes downwardly through the casing. The graphite or prebaked carbon core conducts heat to the paste material to promote more rapid curing.

17 Claims, 5 Drawing Figures

IRON FREE SELF BAKING ELECTRODE

BACKGROUND OF THE INVENTION

This invention relates to self-baking electrodes for use in electric arc furnaces and a method of making the same.

One type of conventional self-baking electrodes comprises a vertically disposed cylindrical casing which extends downwardly through an opening in the roof of an electric arc furnace. The upper end of the casing is open to permit the insertion of a carbonaceous paste-like material which first melts and then cures to a solid state as it passes downwardly through the casing as a result of heat which is conducted upwardly from the cured portion of the electrode extending below the lower end of the casing. Such paste may be made, for example, by calcining anthracite or petroleum or asphalt cokes which is then mixed with a bonding material such as pitch or tar.

In one type of prior art consumable electrode, such as that shown in U.S. Pat. No. 3,715,439, metallic fins are fixed to the internal surface of the casing and extend inwardly toward the center of the electrode to act as a reinforcement and to promote curing by conducting heat to the interior portions of the electrode. This patent also discloses the use of a log core in the electrode to reduce the content of paste required.

Another type of prior art consumable electrode was formed by feeding a carbonaceous electrode forming material into the open upper end of a metallic casing. Electrical current was delivered to the electrode by means of a contact assembly commonly having contact plates and a surrounding pressure ring. A variable pressurizing means, such as a hydraulic cylinder, adjusted the pressure between the contact plates and the casing. A metallic structure was located at the axis of the electrode to which it became bonded as the lower end of the electrode was baked. The metallic structure was generally X-shaped in crosssection and was formed by elongate ladder-like sections. In order to minimize contamination of the material being treated by the metal in the electrode casing, the lower portion of the electrode was lowered by means of the metallic structure through the casing while sufficient pressure was maintained between the contact plates and the casing to prevent the casing from slipping through. Periodically, as the lower edge of the casing was consumed through arcing and oxidation, the entire electrode was lowered while the pressure between the contact plates and the casing was reduced to allow the total composit electrode to slip. As the electrode moved downwardly to replace the portion that was consumed at its tip, the electrode was heated by the high temperature existing within the furnace and by electrode current flowing into the electrode via the contact plates.

In order to control the electrical conditions within the furnace, it is necessary to maintain the lower end of the electrode at a controlled distance from the molten bath. As the lower end of the electrode is consumed, therefore, it is necessary to move the electrode downwardly into the furnace. This necessitates that additional sections of the metallic casing and the fins be attached to the upper end of the electrode and further quantities of electrode forming paste be added. Along with the consumption of the electrode, the metallic casing and fins are also consumed. This results in iron being added to the furnace melt thereby adversely affecting products being produced in the furnace, such as silicon, in which high purity is a requisite.

One method of resolving the problem of iron introduction in the operation of self baking electric arc furnace electrodes is disclosed in U.S. Pat. No. 3,819,841. In particular, this patent discloses a self baking electrode wherein metallic fins are not employed. Rather, heated air is delivered to a space between the surface of the metal casing and a mantle which is spaced from and surrounds the casing. This provides sufficient heat for curing the electrode without the necessity for heat conducting fins. Insulation on the inner surface of the mantle assists baking by minimizing heat loss. In addition, the metallic casing is maintained in a stationary position and feeding of the electrode toward the furnace is accomplished by forcing the cured portion of the electrode outwardly from the lower end of the casing. This substantially minimized the introduction of iron into the melt.

It has been found that the baked portion of the electrode lies below the 250° C. isotherm which begins in the region of the lower end of the electrode contact plates and extends upwardly and inwardly toward the center of the furnace. As long as the paste is baked as it leaves the contact plates, there is no problem with rupture of the electrode being initiated at the outer surface regardless of the strength at that location. However, electrode failure becomes a concern when there is a high rate of electrode consumption, such as in the production of silicon. Should the electrode be consumed at a rate such that the baking zone extends below the level of the contact plates, a zone of weakness is created which can result in electrode breakage. This problem is further complicated when a wooden core or log is provided within the electrode as discussed in U.S. Pat. Nos. 3,715,439 and 3,819,841. The wooden core being less heat conductive than the electrode material tends to retard rather than promote the rate of electrode baking.

SUMMARY OF THE INVENTION

It is an object of the invention to provide a new and improved self baking electrode.

Another object of the invention is to provide an iron free self baking electrode having a greater strength than conventional self baking electrodes.

Another object of the invention is to provide an iron free self baking electrode in which the baking zone occurs at a higher elevation than the conventional self baked electrodes.

These and other objects and advantages of the invention will become more apparent from the detailed description thereof taken with the accompanied drawings.

According to one aspect, the invention comprises a self baking electrode which includes a casing having upper and lower openings, a graphite core disposed within the casing and spaced therefrom, and a quantity of electrode paste disposed in the space between the core and the casing, said paste baking and curing to from hardened electrode material and becoming bonded to said core at a point above the open lower end of the casing.

According to another of its aspects, the invention comprises a method of forming an iron free, self baking submerged arc furnace electrode comprising the steps of placing an elongate graphite core centrally of an elongate metallic housing and spaced from the inner surface thereof, and introducing unbaked electrode forming paste into the space between the casing and the graphite core, and heating the paste adjacent the lower end of the casing to bake the paste into a solid electrode material and to form a bond between the material and the core, the core being operative to conduct heat upwardly into said casing to increase the baking zone of the material.

DETAILED DESCRIPTION OF THE PREFERRED EMBODIMENTS

Figure 1:
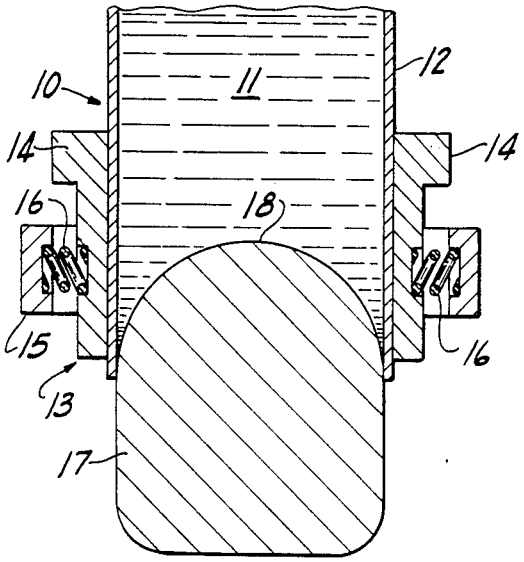
PRIOR ART Fig. 1
FIG. 1 shows the baking zone of prior art self baking electrodes.

FIG. 1 shows the baking profile of a low iron self baking electrode 10. Such electrodes are commonly formed by feeding a carbonaceous electrode forming material 11 into the open upper end of a metallic casing 12. Electrical current is delivered to the electrode 10 by means of a contact assembly 13 which may include contact plates 14 and a surrounding pressure ring 15. Springs 16 between the ring 15 and the contact plates 14 resiliently urge the latter into high pressure engagement with the casing 12. In order to prevent contamination of the material being treated by the metal in the casing 12, the electrode 10 is lowered through the casing 12 and out its open lower end. As the lower end of the electrode emerges from the casing 10 it is heated by the high temperature existing within the furnace and by the electric current flowing between the contact plates 14 and the arc. As the result of this action, the lower portion 17 of the electrode is baked, thereby forming a solid mass. The transition lines 18 between the solidified portion of the electrode 17 and the uncured material 11 is generally defined by a parabola and follows the 250° C. isotherm.

As long as the electrode is baked prior to its emergence from the contact plates 14, the electrode will be sufficiently supported to avoid a rupture. However, when the electrode is employed in processes which result in rapid consumption of the electrodes, such as in the smelting of silicon, so that the residence time of the electrode forming material within the casing 12 is insufficient to maintain the baking zone above the contact plates 14, a zone of weakness is created which may result in a physical failure of the electrode 10. This shortcoming of prior art electrodes is corrected by the electrode which will be described below.

Figure 2:
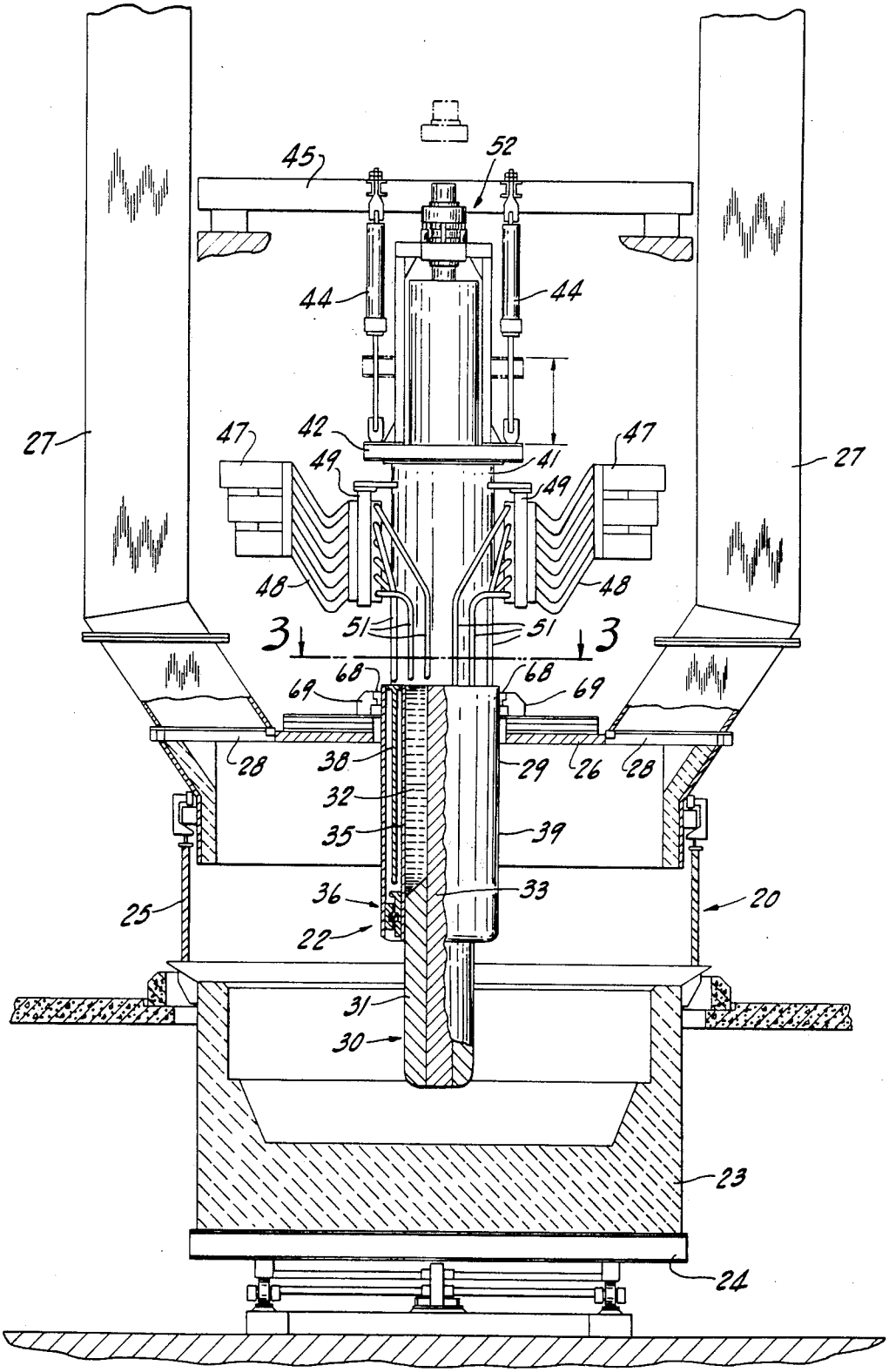
FIG. 2 is a side elevational view, partly in section, schematically illustrating an electric arc furnace in which the electrode in accordance with the invention is employed.

FIG. 2 shows an electric arc furnace 20 in which one or more self baking electrode assemblies 22 in accordance with the preferred embodiment of the invention may be used. The furnace 20 is of a conventional design and may be used, for example, in the smelting of silicon. Accordingly, the furnace 20 will be described only in general terms. In particular, the furnace 20 includes a hearth 23 formed of a suitable refractory material. In the case of a silicon smelting furnace, the hearth may be mounted on a rotatable platform 24. Extending upwardly from the hearth 23 is a hood door or curtain 25 which is engaged at its upper end by a furnace cover or roof 26. A pair of gas collecting conduits 27 are coupled at the lower ends to suitable openings 28 in the roof 26 their opposite ends are connected to a gas cleaning system.

Each electrode assembly 22 extends through an opening 29 in roof 26 and includes an electrode 30 which comprises a baked portion 31, an unbaked portion 32 and a central graphite core 33. A metallic shell 35 surrounds the electrode from its upper end to a point adjacent its lower end. The shell 35 is open ended for receipt of electrode forming past at its upper end and the discharge of the cured electrode at its lower end. In addition, shell 35 is generally smooth sided and uniform in cross-sectional shape.

A conventional electrode contact assembly 36, such as that disclosed in U.S. Pat. No. 3,819,841, surrounds the lower end of the shell 35 and is in pressure engagement therewith. A mantle 38 surrounds and is concentrically spaced from that portion of the shell 35 disposed within the furnace 20 and is located above the contact assembly 36. As also discussed in U.S. Pat. No. 3,819,841 the space between the mantle 38 and the shell 35 may be connected to a source of heated art to facilitate baking of the electrode forming material 32. The mantle may be provided with an insulating lining to enhance baking by minimizing heat loss. Also disposed in surrounding relation to the shell 35 and spaced from the mantle 38 is a heat shield 39 to protect the contact assembly 36 and the mantle 38 from direct exposure to the environment with furnace 20.

The casing 35, the mantle 38 and the shield 39 are all supported from a concentric cylindrical housing 41 which extends upwardly from the furnace roof. A ring 42 is fixed to the upper end of the housing 41 and a pair of lift cylinders 44 are connected at their lower ends to the ring 42 and at their upper ends to an overhead beam 45 which is rigidly supported. As those skilled in the art will appreciate, the cylinders 44 are operative to position the lower end of the electrode 30 in relation to the charge disposed within the furnace 20. In particular the cylinders 44 will be connected to a control assembly (not shown) which is responsive to the electrical parameters such as electrode current and voltage. The positioning assembly attempts to regulate the length of the arc by moving the lower end of the electrode relative to the furnace charge as changes in voltage and current indicate deviations in the length of the arc from the desired values. While the electrode will be moved both upwardly and downwardly, the predominant direction of electrode movement will be towards the furnace hearth 23 because the lower end of the electrode 30 will be consumed in the furnace process. As the result, it will be necessary to "slip" the electrode as will be described more fully below.

Electrical energy is supplied to the electrode 30 from bus bars 47 which are coupled by flexible connectors 48 to terminals 49 mounted on housing 41. Conductors 51 extend downwardly from terminals 49 where their lower ends are connected to the electrode clamp 36 in a manner well known in the art, such as for example as shown in U.S. Pat. No. 3,819,841.

Figure 4:
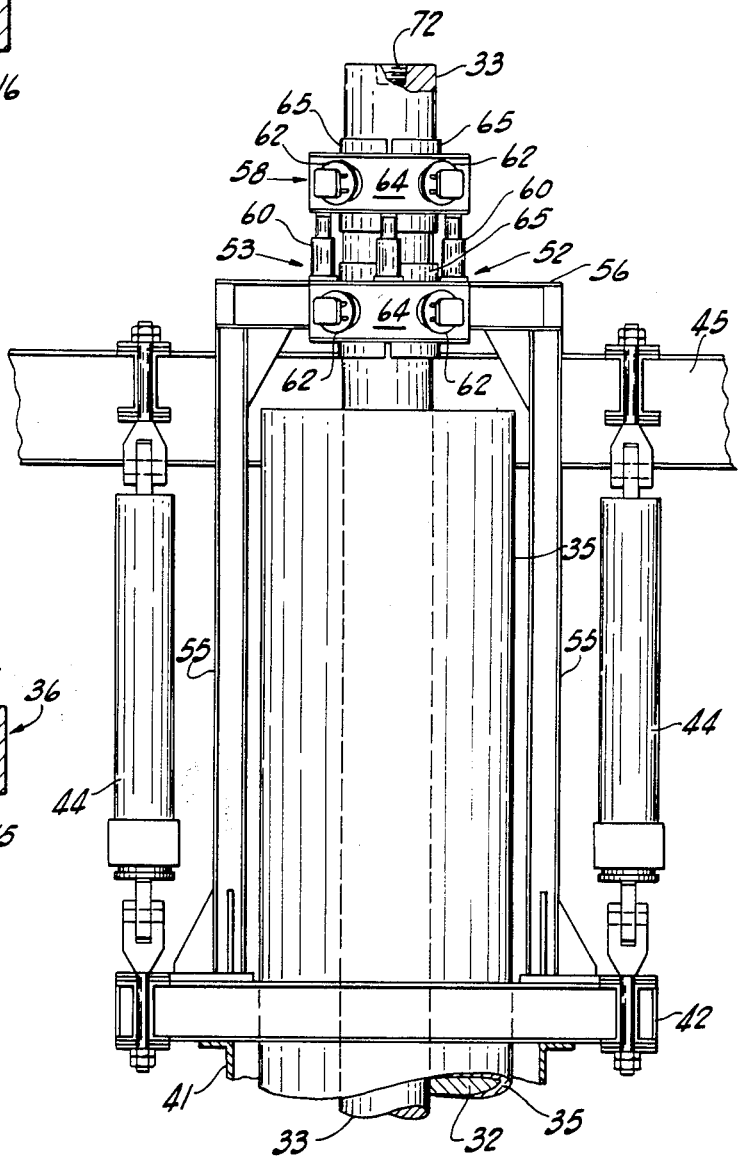
FIG. 4 is a side elevational view of a portion of the arc furnace shown in FIG. 2.
Figure 3:
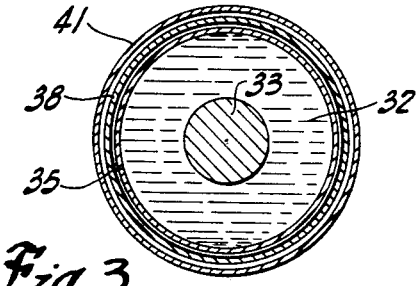
FIG. 3 is a view taken along lines 3—3 of FIG. 4.

It will be appreciated that when the electrode 30 has been moved to the lower travel limit of cylinders 44, it will be necessary to perform an electrode slipping operation. This involves moving the electrode 30 axially toward the furnace and relative to the casing 35 and the housing 41. This permits the housing 41 to be elevated relative to furnace 20 so that movement of the electrode toward the furnace under the influence of the cylinders 44 may resume. Toward this end, the electrode slipping assembly 52 is provided. The assembly is shown more specifically in FIG. 4 to include a first clamp assembly 53 which is supported on the ring 42 and above the upper end of the electrode casing 35 by means of a frame consisting of a pair of vertical columns 55 supported at their lower ends on the rings 42 and a support 56 mounted at the upper end of columns 55. A second clamp assembly 58 is supported above the support 56 by a plurality of slipping cylinders 60. The clamp assemblies 53 and 58 are conventional and each includes a plurality of spaced apart pressure cylinders 62 which are mounted on a frame 64. Each pressure cylinder 62 engages a contact shoe 65 for urging the same into high pressure engagement with the surface of the graphite core portion 33 of the electrode 30. It wil be appreciated that the contact of shoes 65 are disposed in surrounding relation to the electrode core 33 so each clamp assembly is individually operated to support an electrode 30. Additionally, the slipping cylinders 60 are operative to move the clamp assembly 58 vertically relative to the support 56 when clamp 53 is engaged and clamp 58 is disengaged and are further operative to move the electrode 30 downwardly and through the casing 35 when clamp 58 is engaged and the clamp 53 is disengaged.

Figure 5:
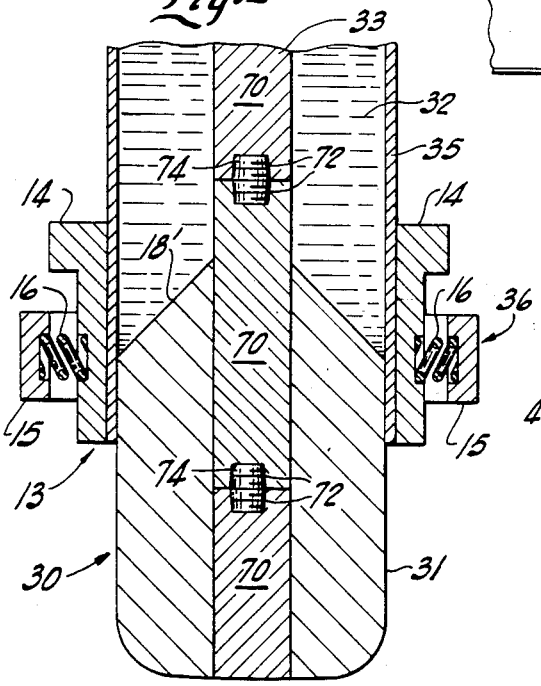
FIG. 5 illustrates the baking zone of the electode in accordance with the invention.

As seen in FIG. 5, the electrode core 33 is fabricated of individual cylindrical section 70 each of which has a threaded axial opening 72 at each end which threadably receives a tapered plug 74 in a manner well known in the art.

During a normal furnace operation, the electrode 30, the casing 35, the contact assembly 36, the mantle 38, the housing 39, the terminals 49, and the slipping assembly 52 will all be moved in unison by the positioning cylinders 44 so that the length of the arc and hence arc voltage and current will be within some preset limits. A set of circumferential spaced guide rollers 68 are journalled for rotation on associated stationary supports 69 to maintain alignment between the electrode assembly 22 and the opening 29 and the furnace roof 26.

FIG. 5 is an enlarged view showing the lower end of the electrode 30. This illustrates that the baking profile, which again follows the 250° C. isotherm 18', is substantially conical in shape and extends upwardly from the contact assembly 14 to it point of intersection with the core 33. It can also be seen from a comparison of FIGS. 1 and 5 that the isotherm 18' intersects the the contact shoes 14 at a higher elevation than in the case of prior art self baking electrodes shown in FIG. 1. This occurs because the graphite core 33 acts as a heat conductor whereby the baking zone will be increased, particularly in the area adjacent the core 33.

It has been found in laboratory scale tests that the bonding strength between the smooth graphite core 33 and the baked portion of the electrode 31 is such that tensile load failure would occur in the body of the electrode 31 and not as result of exceeding the shear strength at the carbon-graphite interface. In particular, the average ultimate shear strength of the bond between the rod 33 and the baked paste 31 at 25° C. is $83 \pm 11$ psi versus an average tensile strength in the cured portion 31 of 49 psi. It was found that a high degree of porosity existed between the graphite and baked paste interface as a result of the loss of volitile constituents during bake out. Patches of paste material attached to the rod after the two had been separated in the testing indicates that the paste penetrated the pores in the surface of the core 33 and that volatiles had cracked throughout the bonding zone. From these observations it was concluded that the nature of the bond between the graphite and the paste baked into the graphite consist of interpenetration of the paste and cracked volitiles at their surface of contact.

Because the strength of the bond between the baked paste 31 and the graphite core 33 and the generally conical shape of the cured zone extending upwardly and inwardly, the possibility of electrode failure is reduced even if the electrode is consumed at such a rate that the outer edge of the transition between the baked tip 31 and the paste 32 should extend to the lower edges of the contact shoes 14. This can provide improved safety factors of up to about four, whereas the safety factor in conventional self baked electrodes is only a fraction above one.

The operation of the electrode assembly 22 will be discussed with the assumption that the furnace 20 is in operation and formation of the electrode 30 has progressed to the point shown in FIG. 2. When in this state, the electrode 30 will be in several stages of curing. As indicated previously, the lower end 31 is fully cured, the portion within the shield 39 and above the cured lower end 30 will be unbaked. In the thin conical or somewhat parabolic layer separating these two regions, the binder is molten. The electrode forming material will penetrate the pores of the core 33 at this level to facilitate bonding.

The hydraulic rams 44, acting under the influence of the control system (not shown), will move the electrode assembly 22 toward and away from the furnace as electrical conditions dictate. However, the motion of the electrode will be predominantly toward the furnace as the lower end 31 is consumed. When the hydraulic cylinders 44 reach their lower travel limits, an electrode slipping operation will be required. At this time, the electrode clamp 53 will be disengaged and the double acting slipping cylinders 60 will be actuated to force the clamp 58 downwardly toward the support 56. As the result of the engagement between the clamp shoes 65 and the graphite core 33, the cured lower end 31 of the electrode which is bonded to the core 33 will be forced downwardly and out of the lower end of the casing 35. The transition between the cured electrode tip 31 and the uncured fluid electrode forming material 32 will not move past the electrode clamps 14.

After the electrode 30 has been slipped downwardly, the clamp 53 is re-engaged after which the clamp 58 is disengaged. The slipping cylinders 60 are then operated to elevate the clamp 58 to a new position relative to the core 33. The clamp 58 is then re-engaged. After each slipping operation, the level of uncured paste 32 in the casing 35 will decrease. Accordingly, additional electrode forming paste material will be added to the upper end of the casing. In addition, a further electrode section 70 will be added to the upper end of the core 33 by the addition of a nipple 74 to the existing core 33 and the threading of the additional section 70 thereto.

While only a single embodiment of the invention is illustrated and described it is not intended to be limited thereby but only by the scope of the appended claims.

I claim:

1. In combination with an electric arc furnace, an iron free self baking electrode comprising an open ended, outer metallic shell disposed within said furnace and oriented generally vertically, a center core of prebaked carbonaceous material disposed within and spaced from the shell, a quantity of carbonaceous electrode forming paste disposed within the shell in surrounding relation to the core, said paste being of a type which cures into a solid electrode and bonds to the carbonaceous core as the paste passes downwardly through the shell, the lower end of said electrode being cured and extending from the lower end of said shell where it is exposed to the heat within the furnace, and means engaging said electrode adjacent the lower end of the shell for conducting electrical discharge current to the cured lower end of the electrode and bypassing the upper portion thereof to heat the material within the furnace, said current also providing heat for curing said paste, the carbonaceous core conducting heat upwardly to the electrode forming material to promote more rapid curing of said paste whereby said paste cures at an elevation above the lower end of said shell.

2. The combination set forth in claim 1 wherein said core comprises an elongate body formed of graphite.

3. The combination set forth in claim 1 wherein said core comprises an elongate body formed of prebaked carbon.

4. The combination set forth in claims 2 or 3 wherein the isotherm between the cured and uncured portions of said electrode is generally frusto conical and lies above the lower end of said shell.

5. The electric arc furnace set forth in claim 4 wherein said shell is smooth sided and generally uniform in cross-sectional configuration.

6. An electric furnace for the production of silicon comprising a furnace body for containing a charge to be heated, a self baking electrode extending downwardly into said furnace body, said electrode including an open ended shell, a center core disposed within and spaced from said shell, said core comprising a preformed body of prebaked, heat conductive, carbon containing material, a quantity of unbaked carbonaceous material disposed between the shell and the body, said carbonaceous material being of a type which cures into a solid electrode and bonds to the core as the carbonaceous material passes downwardly through the shell, a portion of the cured carbonaceous material extending from the lower end of said shell, electrical contact means engaging the electrode adjacent the lower end of the shell for conducting current to the cured lower end of the electrode and bypassing the upper end thereof whereby said current discharges from the electrode to heat the furnace charge without incurring losses associated with passage of said current through the entire length of the electrode, means supporting the metallic shell against movement inwardly relative to the furnace body, the upper end of the core extending outwardly from the upper end of said shell, and electrode slipping means engaging the exposed upper end of said core for forcing said core and the electrode bonded thereto downwardly and out of the lower end of said shell, the core conducting heat upwardly to the carbonaceous material above the lower end of the shell to promote curing of said carbonaceous material before the lower end thereof is forced outwardly from said shell.

7. The electric furnace set forth in claim 6 wherein said core comprises an elongate body formed of graphite.

8. The electric furnace set forth in claim 7 wherein said core comprises an elongate body formed of prebaked carbon.

9. The electric furnace set forth in claims 7 or 8 wherein the isotherm between the cured and uncured portions of said electrode is generally frusto conical and lies above the lower end of said shell.

10. The electrode set forth in claim 9 wherein said shell in smooth sided and generally uniform in cross section in configuration.

11. A method of forming an iron free, self baking electrode in an electric arc furnace in which the electrode is to be used, comprising the steps of:

disposing an elongate, preformed core of a carbon containing material within and spaced from an open ended, elongate shell located within the furnace, placing a quantity of carbonaceous material in the space between the shell and the body, said carbonaceous material being of a type which cures upon heating to form a solid electrode which bonds to the core, exposing one open end of the metallic shell to the heat within the electric arc furnace, supporting the shell for limited movement into the furnace, progressively forcing one end of the core and the carbonaceous material bonded thereto from the one end of the shell and into the furnace, passing an electric current solely through that portion of the electrode which extends downwardly from the lower end of said shell thereby striking an arc within the electric arc furnace for heating a material therein and for generating heat for curing that portion of the material adjacent the lower end of the electrode for curing the carbonaceous material to form the electrode, and conducting heat upwardly from the lower end of said electrode through said core to the carbonaceous material disposed above the lower end of the electrode for curing said material at a level above that which would be cured by the heat within the furnace and the electrical current flowing through the electrode.

12. The method set forth in claim 11 wherein the core comprises an elongate body formed of graphite.

13. The method set forth in claim 12 wherein the core comprises an elongate body formed of prebaked carbon.

14. The method set forth in claims 12 or 13 and including the steps of adding additional unbaked carbonaceous material to the casing as the core and cured electrode material have been forced from the one end of the shell.

15. The method set forth in claim 14 wherein said core is formed of a plurality of cylindrical sections which are joined end-to-end and adding additional sections to the opposite end of the core after a corresponding section of the other end of the core and electrode bounded thereto has been forced from the casing.

16. The method set forth in claim 11 wherein said shell is oriented generally vertically and the one end is its lower end, said carbonaceous material becoming cured at a level above the lower end of said shell.

17. The method set forth in claim 16 wherein the isotherm within said electrode which defines the boundry between the cured and uncured portions of said electrode is generally conical and extends downwardly and outwardly relative to said core and with its lower end being disposed above the one end of the shell.

* * * * *